US005415154A

United States Patent [19]

Angeloni

[11] Patent Number: 5,415,154

[45] Date of Patent: May 16, 1995

[54] DROPAWAY ARROW REST AND OVERDRAW ASSEMBLY

[75] Inventor: Joseph Angeloni, Peckville, Pa.

[73] Assignee: A Design, Inc., Peckville, Pa.

[21] Appl. No.: 134,822

[22] Filed: Oct. 12, 1993

[51] Int. Cl.[6] ..... F41B 5/00

[52] U.S. Cl. ..... 124/44.5; 124/24.1

[58] Field of Search ..... 124/24.1, 41.1, 44.5

[56] References Cited

U.S. PATENT DOCUMENTS

| | | | |
|---|---|---|---|
| 2,975,780 | 3/1961 | Fisher | 124/24.1 |
| 3,504,659 | 4/1970 | Babington . | |
| 4,071,014 | 1/1978 | Trotter . | |
| 4,287,868 | 9/1981 | Schiff | 124/24.1 |
| 4,492,214 | 1/1985 | Kielhoffer . | |
| 4,865,007 | 9/1989 | Saunders . | |
| 4,865,008 | 9/1989 | Troncoso . | |
| 4,879,988 | 11/1989 | Larson . | |
| 4,886,038 | 12/1989 | Betters . | |
| 4,903,678 | 2/1990 | Walker . | |
| 4,917,070 | 4/1990 | Townsend . | |
| 5,005,554 | 4/1991 | Shepley et al. . | |
| 5,022,378 | 6/1991 | Rhodehouse et al. . | |
| 5,140,972 | 8/1992 | Fisk . | |
| 5,146,908 | 9/1992 | Larson . | |
| 5,161,514 | 11/1992 | Cary . | |
| 5,205,268 | 4/1993 | Savage | 124/24.1 |

OTHER PUBLICATIONS

Ad: Whitetail Bowhunter, Fall 1993, pp. 32–33.

Discount Warehouse, Inc., Catalog, Summer Ed. 1993, pp. 1, 25–33.

*Primary Examiner*—Dave W. Arola

*Assistant Examiner*—Anthony Knight

*Attorney, Agent, or Firm*—Sughrue, Mion, Zinn, Macpeak & Seas; Richard C. Turner; Joseph J. Buczynski

[57] ABSTRACT

An arrow rest and overdraw assembly for use with a compound bow. The apparatus comprises a bracket mounted to the frame of the compound bow, an arrow rest/overdraw arm pivotally mounted to the bracket, and an actuator arm pivotally mounted to the arrow rest/overdraw arm and a cable slide. The arrow rest is coupled to the arrow rest/overdraw arm. The cable slide is slidably mounted to the cable guard of the bow and coupled to the tuning cables of the bow. When the bowstring is in the released position, the arrow rest-/overdraw arm and actuator arm are in a rest state which positions the arrow rest below the line of fire of the arrow. As the bowstring is drawn back, the rearward lateral movement of the tuning cables that occurs causes the cable slide to slide along the cable guard in a direction toward the archer and pivot the actuator arm relative to the arrow rest overdraw arm to lift the arrow rest to align the arrow for firing. When the bowstring is released, the forward lateral movement of the tuning cable cause the cable slide to slide along the cable guard in a direction away from the archer and pivot the actuator arm relative to the arrow rest/overdraw arm in a direction substantially reverse to the direction of movement occurring during drawing of the bowstring. This simple mechanical action causes the arrow rest to drop out of the path of the arrow as the arrow rest/overdraw arm and actuator arm return to their rest state.

20 Claims, 10 Drawing Sheets

DROPAWAY ARROW REST AND OVERDRAW ASSEMBLY

BACKGROUND OF THE INVENTION

1. Field of the Invention

The present invention relates to an integral arrow rest and overdraw assembly for use with a compound bow.

2. Description of the Related Art

In the sport of archery, compound bows exist which, unlike standard long bows, comprise a plurality of pulleys. The pulleys cooperate with tuning cables and the bowstring to enable an archer to hold the bowstring in a drawn position with ease.

Compound bows can be used with various types of arrows. Arrows typically have three or more feathers or vanes, which are commonly known as fletching. The fletching may extend radially outward perpendicularly from the arrow shaft. Alternatively, the fletching may extend radially outward from the shaft while being helixed slightly to induce spin on the arrow and thereby facilitate arrow flight.

Whether a compound bow is used for target shooting or hunting, it is desirable that the flight of the arrow shot from the bow be as accurate as possible. A major factor affecting the accuracy of the arrow flight is the arrow rest upon which the arrow lies when loaded into the bow. That is, the fletching of the arrow often strikes the arrow rest when the arrow is released from the bow, thus impeding the smooth flight of the arrow.

Numerous arrow rests exist, each being designed to minimize contact with the arrow fletching and/or to compensate for the deflection of the arrow as it passes over the arrow rest. Often, an archer will choose arrows having a fletching configuration best suited for use with a particular type of arrow rest or vice versa.

In addition to selecting an appropriate arrow rest and arrows, an archer often may wish to use an arrow that is shorter than the standard arrow. These shorter arrows are lighter, stiffer and fly farther and faster with a flatter trajectory than a standard arrow. However, when a compound bow loaded with a short arrow is drawn back to full extension, the reduced length of the arrow shaft causes the front end (arrow end) of the short arrow to be pulled off of the arrow rest. Hence, the arrow will fall away from the bow thus increasing the risk of injury to the archer.

To use such shorter arrows with a compound bow, an apparatus known as an overdraw assembly is available which attaches to the handle portion of the compound bow and extends rearwardly toward the archer, thus positioning the arrow rest attached thereto at a location behind the handle of the bow. For example, as described in U.S. Pat. No. 4,879,988, an overdraw assembly extends rearwardly from the shaft of the compound bow and has the arrow rest mounted thereto. That is, instead of the arrow rest being mounted directly to the handle portion of the frame of the compound bow, the overdraw assembly positions the arrow rest several inches behind the frame. Hence, a shorter arrow can be loaded in the bow and the bowstring can be drawn back without pulling the front of the arrow off of the arrow rest.

As shown in U.S. Pat. No. 4,879,988, and, for example, U.S. Pat. Nos. 4,865,007, 4,865,008, it is desirable to have an overdraw assembly having an arrow rest that moves out of the path of the arrow when the arrow is released. As described in these patents, the fletching strikes the arrow rest and moves the arrow rest out of position, thus allowing only minimal contact between the arrow rest and fletching and providing a more accurate trajectory. Furthermore, damage to the fletching is minimized. Nevertheless, even though such arrow rest devices mounted on overdraw assemblies are intended to provide a flatter trajectory, the resistance caused by the fletching striking these arrow rests still adversely affects the path of the arrow and also damages the fletching, although to a lesser degree.

U.S. Pat. No. 4,071,014 teaches an arrow rest assembly that automatically, upon release of the bowstring, springs out of the path of the arrow. In this arrangement, it is not necessary for the fletching of the arrow to strike the arrow rest to move the arrow rest out of the path of the arrow. However, such an assembly is incorporated into the handle portion of the frame of the compound bow and does not provide an overdraw feature. Hence, it was desirable to develop an arrow rest which is mounted to an overdraw assembly and automatically falls out of the arrow's path without interfering with the fletching of the arrow.

Such an apparatus is described, for example, in U.S. Pat. No. 5,161,514. In that apparatus, the arrow rest and overdraw assembly is mounted to the frame of the compound bow and comprises a special hollow rod extending rearwardly from the frame. A spring-loaded release mechanism is attached to the hollow rod at an end of the rod closest to the frame. A cable slide is disposed about the hollow rod and attached to the tension cables (tuning cables) of the bow to slidably move along the rod when the bow is drawn back. This action allows the spring loaded mechanism to lift the arrow rest and consequently lift the arrow to a position for firing.

When the arrow is released, the cable slide moves forward along the rod and cooperates with a pin in the rod to forcibly compress the spring loaded mechanism and thereby move the arrow rest downward and away from the path of the arrow. Although such an apparatus achieves the object of providing an overdraw assembly having an arrow rest that automatically moves away from the path of the arrow so as to not interfere with the fletching, such a complicated apparatus has many interengaging and moving parts which are costly and highly susceptible to wear and tear. Furthermore, because a special hollow cable guard is needed, the apparatus is not adaptable with a standard cable guard on a standard compound bow.

In addition, the noise caused by the spring activated mechanism can scare a game animal such as a deer and consequently result in the hunter missing his intended target. These disadvantages thus render such an apparatus impractical and present a need for an overdraw and arrow rest assembly which is simple, quiet, inexpensive and less susceptible to wear and tear.

SUMMARY OF THE INVENTION

Accordingly, the present invention provides an arrow rest and overdraw assembly that is adaptable with a standard compound bow. The apparatus provided by the present invention is a springless, free moving hinged dropaway assembly that pivots synchronously with the movement of the tuning cables so that the arrow rest/overdraw assembly lifts and aligns the arrow for firing when the bowstring is pulled back, and drops away from the path of the arrow when the bowstring is released.

The arrow rest/overdraw assembly comprises a bracket mounted to the frame of the compound bow. An arrow rest/overdraw arm is pivotally mounted to the bracket at one end and pivotally mounted to an actuator arm at the other end. The opposite end of the actuator arm is pivotally attached to a cable slide which is slidably mounted to the cable guard of the bow and attached to the tuning cables of the bow.

When the bowstring is in the released position, that is, not drawn back, the arrow rest/overdraw arm and actuator arm are positioned in a rest position. This positions the arrow rest and arrow guide, which are attached to the arrow rest/overdraw arm, below the typical line of fire of the arrow. As the bowstring is drawn back, the rearward lateral movement of the tuning cables that occurs causes the cable slide to slide along the cable guard in a direction toward the archer and thereby pivot the actuator arm relative to the arrow rest/overdraw arm. This simple mechanical action lifts the arrow rest and arrow guide assembly, mounted to the arrow rest/overdraw arm, to position and align the arrow, loaded in the bow, for firing.

When the bowstring is released, the forward lateral movement of the tuning cable cause the cable slide to slide along the cable guard in a direction away from the archer and thereby pivot the actuator arm relative to the arrow rest/overdraw arm in a direction substantially reverse to the direction of movement occurring during drawing of the bowstring. This simple mechanical action causes the arrow rest and arrow guide assembly to drop out of the path of the arrow as the arrow rest/overdraw arm and actuator arm return to their rest state. No springs or other complicated mechanisms for applying force to the apparatus are needed. The apparatus is driven entirely by the movement of the actuator arm in synchronism with the movement of the tuning cables.

In addition, the arrow rest is adaptable to be mounted to a compound bow having a cable guard below the center line of the frame, that is, below a handle of the frame by which an archer holds the compound bow. Thus, the arrow rest/overdraw assembly can be used with virtually any type of compound bow configuration.

BRIEF DESCRIPTION OF THE DRAWINGS

These and other objects and advantages of the invention will become more apparent and more readily appreciated from the following detailed description of the presently preferred exemplary embodiments of the invention taken in conjunction with the accompanying drawings, of which.

DETAILED DESCRIPTION OF THE PREFERRED EMBODIMENTS

Figure 1:
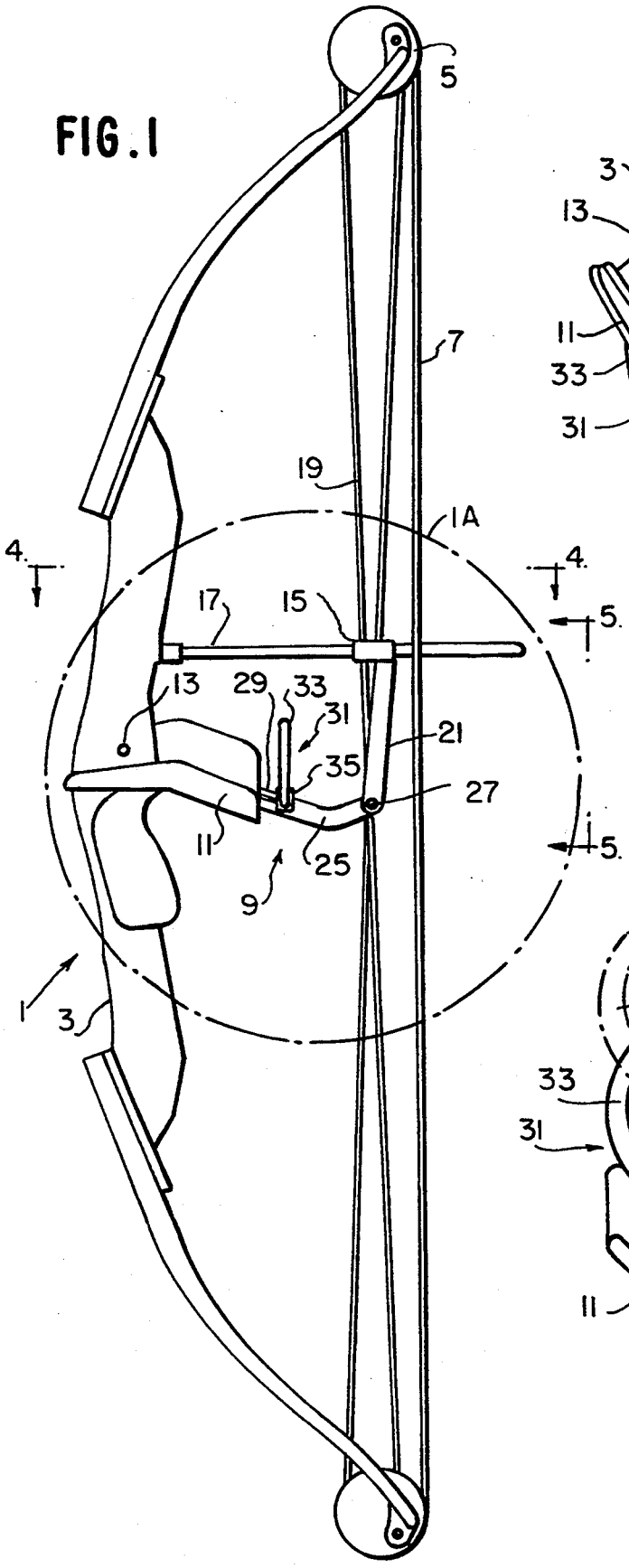
FIG. 1 is a diagrammatic view of a standard compound bow having a first embodiment of the arrow rest/overdraw assembly mounted thereto and being in a rest position.
Figure 1A:
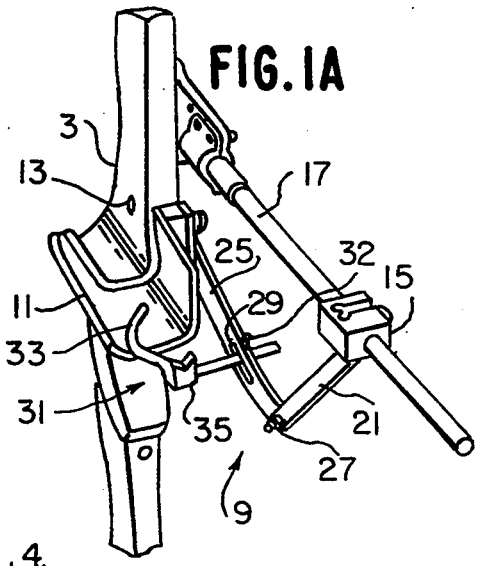
FIG. 1A is a detailed perspective view of the compound bow and arrow rest/overdraw assembly as shown in FIG. 1 in the rest position.
Figure 2:
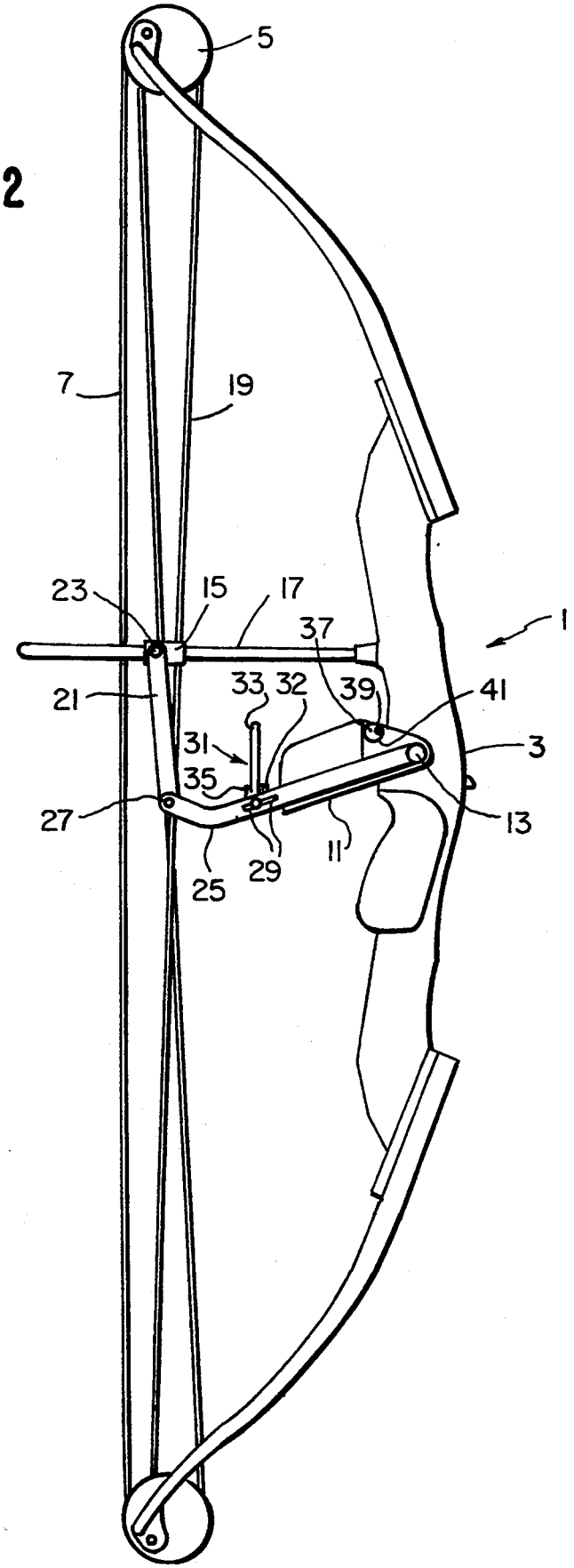
FIG. 2 is a diagrammatic view of the opposite side of the compound bow and arrow rest/overdraw assembly as shown in FIG. 1.

FIGS. 1, 1A and 2 illustrate a first embodiment of the arrow rest/overdraw assembly of the present invention mounted to a compound bow 1 in a rest state. The compound bow 1 comprises a frame 3, and pulleys 5 at opposite ends of the frame for attaching a bowstring 7 to the frame.

The arrow rest/overdraw assembly 9 comprises a bracket 11 mounted to the frame 3 by a screw 13 or any suitable mounting device. The arrow rest/overdraw assembly further comprises a cable slide 15 slidably mounted to the cable guard 17 of the compound bow 1, which typically extends from the frame 3 at some distance from the center line of the frame 3. The cable slide 15 is further attached to at least one of the tuning cables 19.

An actuator arm 21 is pivotally mounted to the cable slide 15 by screw 23 as shown in FIG. 2. The other end of actuator arm 21 is pivotally mounted to the arrow rest/overdraw arm 25 by screw 27. The other end of arrow rest/overdraw arm 25 is pivotally mounted to the bracket and frame by screw 13. However, if desired, the arrow rest/overdraw arm 25 can be mounted to the bracket or frame by an independent screw.

The arrow rest/overdraw arm 25 has a slot 29 therein with an enlarged hole 34 (FIG. 7) in which an arrow guide/arrow rest assembly 31 is slidably mounted, and secured in place by screw 32. Arrow rest/arrow guide assembly 31 comprises an arrow guide 33 and arrow rest 35. Screw 32 can be adjusted to allow the arrow rest/arrow guide assembly 31 to move in hole 34 to a desired position. That is, screw 32, for example, can be a screw-type device which is tightened to position the arrow rest/arrow guide assembly 31 at a desired position and loosened to allow movement of the arrow rest/arrow guide assembly 31 in hole 29.

The bracket 11 further comprises an adjustable height limit stop 37 which comprises a cam 41 which is mounted in an off-center fashion to the bracket 11 by screw 39. Screw 39 can be unscrewed to allow the cam 41 to be moved in a desired position. When the arrow rest/overdraw arm 25 moves upward when the bowstring 7 is drawn back, as described hereunder, arrow rest/overdraw arm 25 abuts against cam 41 and thus, cam 41 prevents arrow rest/overdraw arm 25 from moving upward further. Hence, cam 41 can be rotated accordingly to allow more or less vertical movement of the arrow rest/overdraw arm 25.

Figure 3:
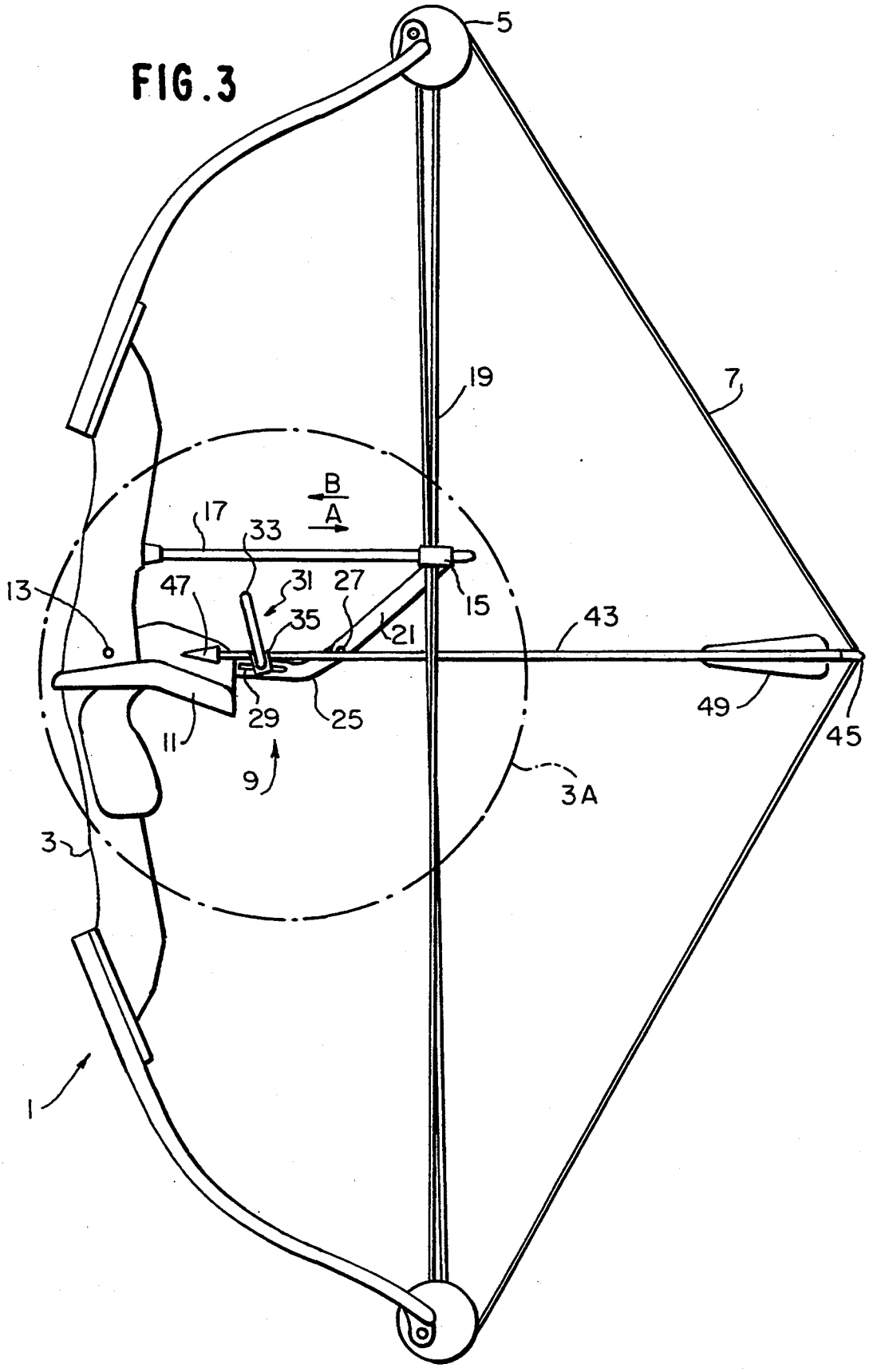
FIG. 3 is a diagrammatic view of the bow and arrow rest/overdraw assembly as shown in FIG. 1 in a drawn-back position.

As shown in FIG. 3, a short arrow 43 can be mounted in the compound bow 1. To mount the short arrow 43, the notch portion 45 of the arrow 43 is engaged with the bowstring 7 and the forward portion of the arrow 43, having the tip 47, is laid over the bracket 11 and arrow rest/arrow guide assembly 31.

Figure 3A:
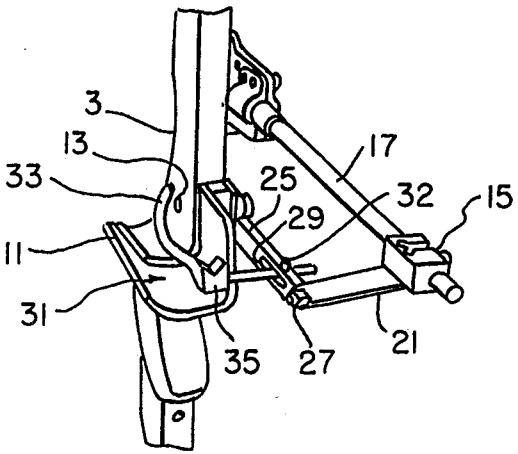
FIG. 3A is a detailed perspective view of the compound bow and arrow rest/overdraw assembly as shown in FIG. 3 in the drawn-back position.

As shown in FIGS. 1, 1A and 2, when the bowstring 7 is not drawn back, the arrow rest/overdraw arm 25 and actuator arm 27 are in a rest position. As the bowstring 7 is drawn back when the arrow 43 is loaded in the bow, the rearward lateral movement of the tuning cables 19 that occurs causes the cable slide 15 to slide along the cable guard 17 in a direction toward the archer as shown by arrow A in FIG. 3. This movement causes the actuator arm 21 to pivot relative to the arrow rest/overdraw arm 25. As shown in FIGS. 3 and 3A, this pivoting action lifts the arrow rest/overdraw arm 25 and thus lifts the arrow guide/arrow rest assembly 31 to lift the arrow 43 in a firing position. This movement is further illustrated in FIGS. 4–7.

Figure 5:
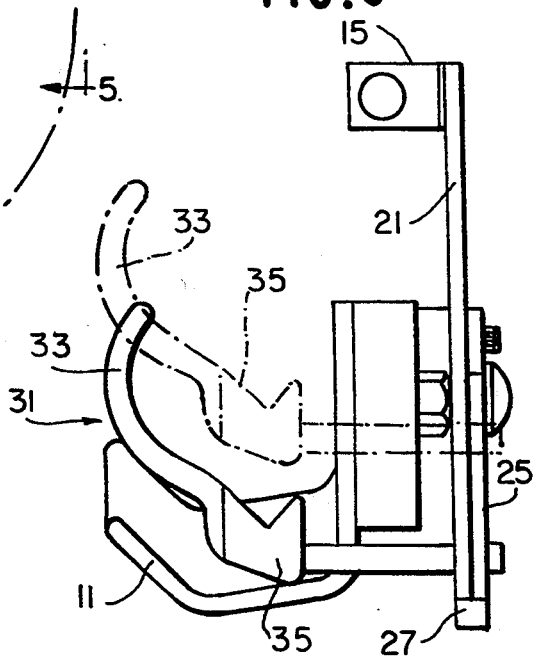
FIG. 5 is a diagrammatic view of the arrow rest/overdraw assembly of FIG. 1, less the compound bow, taken along lines 5—5 in FIG. 1.
Figure 4:
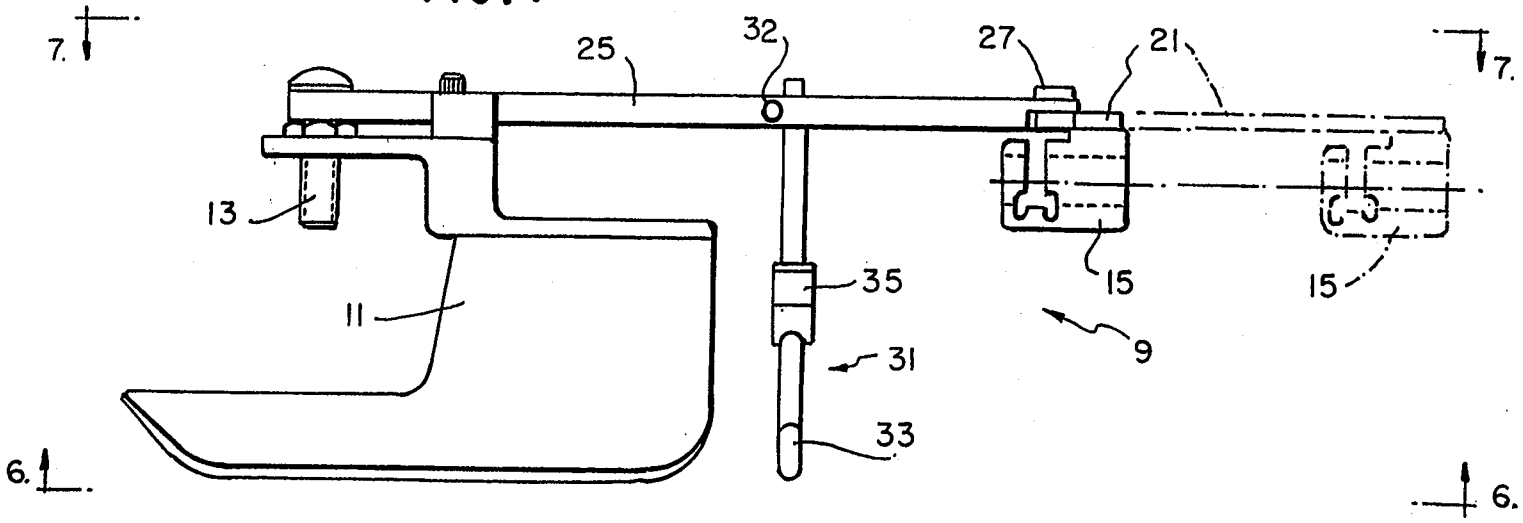
FIG. 4 is a diagrammatic view of the arrow rest/overdraw assembly of FIG. 1, less the compound bow, taken along lines 4—4 in FIG. 1.

For example, as shown in FIG. 4, the arrow rest-/overdraw assembly 9 is in the rest position, and moves into the loaded position as cable slide 15 moves backward. As shown in FIG. 5, the arrow rest/arrow guide assembly 31 moves in an upward position to lift the arrow in a loaded position ready for release.

Figure 6:
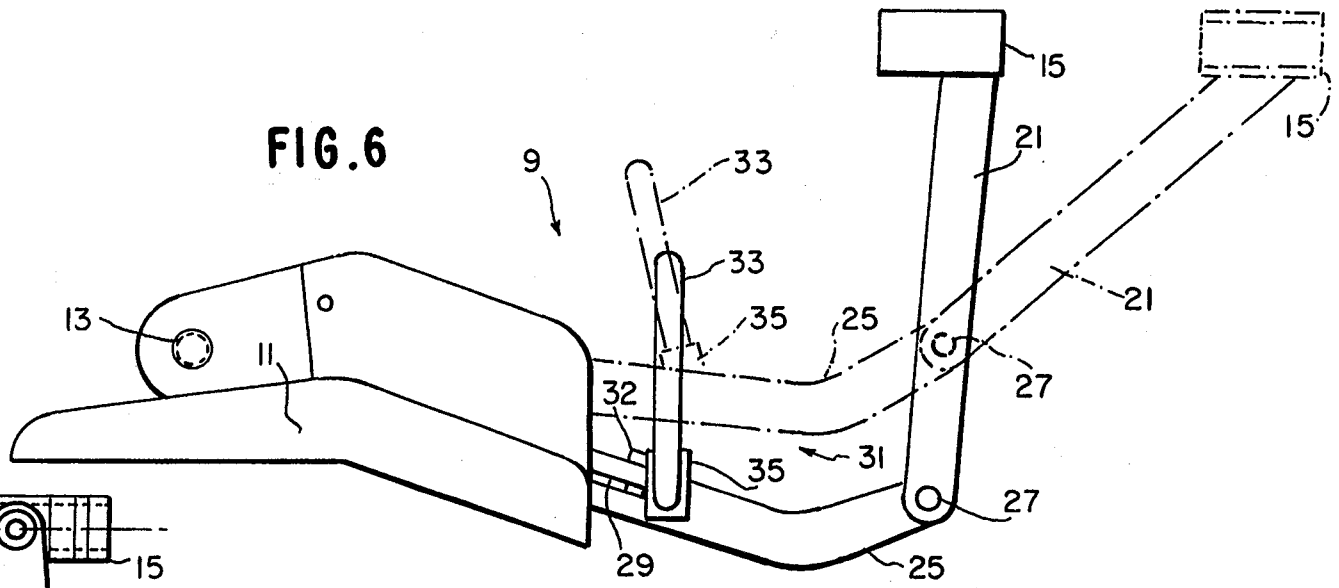
FIG. 6 is a diagrammatic view of the arrow rest/overdraw assembly, less the compound bow, taken along lines 6—6 in FIG. 4.
Figure 7:
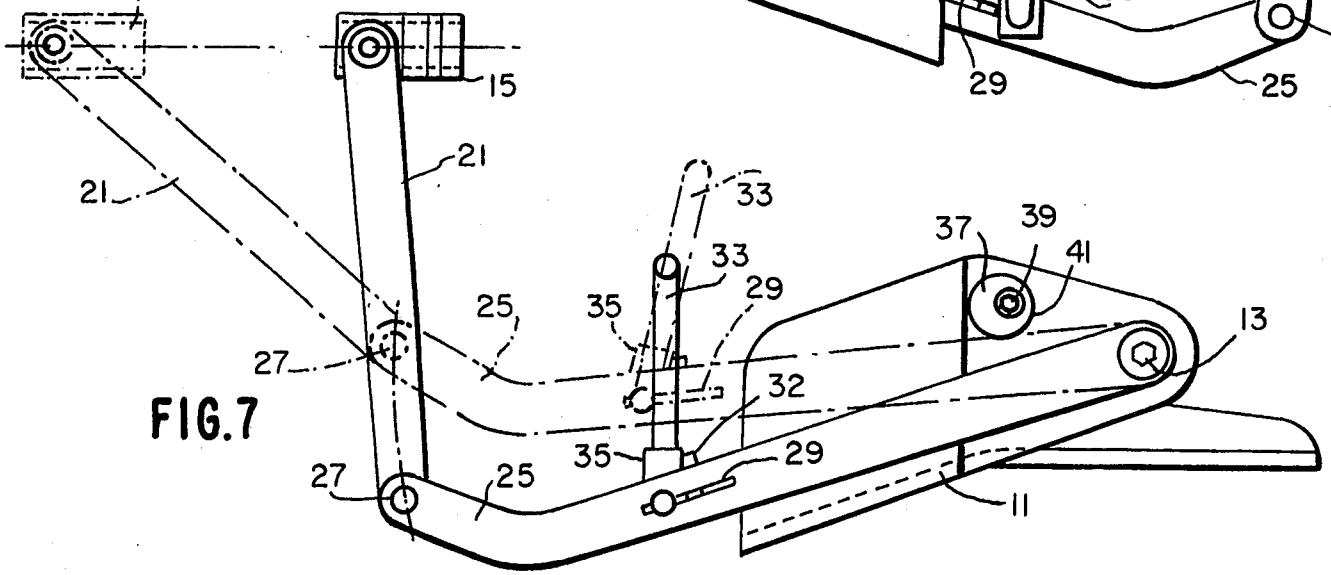
FIG. 7 is a diagrammatic view of the arrow rest/overdraw assembly, less the compound bow, taken along lines 7—7 in FIG. 4.

FIGS. 6 and 7 illustrate how the actuator arm 21 pivots relative to the arrow rest/overdraw arm 25 at screw 27 to move the arrow rest/arrow guide assembly 31 in an upward direction. Also, as shown in FIG. 7, the arrow rest/overdraw arm 25 abuts against the disc 41 which prevents further vertical movement.

When the bowstring 7 is released, the bow 1 returns to its rest state and thus the bowstring 7 pushes the arrow 43 forward in a direction of flight. When this occurs, the forward movement of the tuning cables 19 move the cable slide 15 in a direction shown by arrow B in FIG. 3.

This movement is in reverse to the movement caused by drawing the bowstring 7 back and thus, actuator arm 21 pivots relative to arrow rest/overdraw arm 25 about pivot screw 27. This movement causes the arrow rest-/overdraw arm 25 to move out of the path of the arrow 43 and thus moves the arrow guide/arrow rest assembly 31 out of the path of the arrow 43 before the fletching 49 of the arrow 43 reaches the arrow rest/arrow guide assembly 31. Hence, no interference between the fletching and the arrow rest 35 or arrow guide 31 occurs and an accurate flight of the arrow 43 is achieved.

Figure 8:
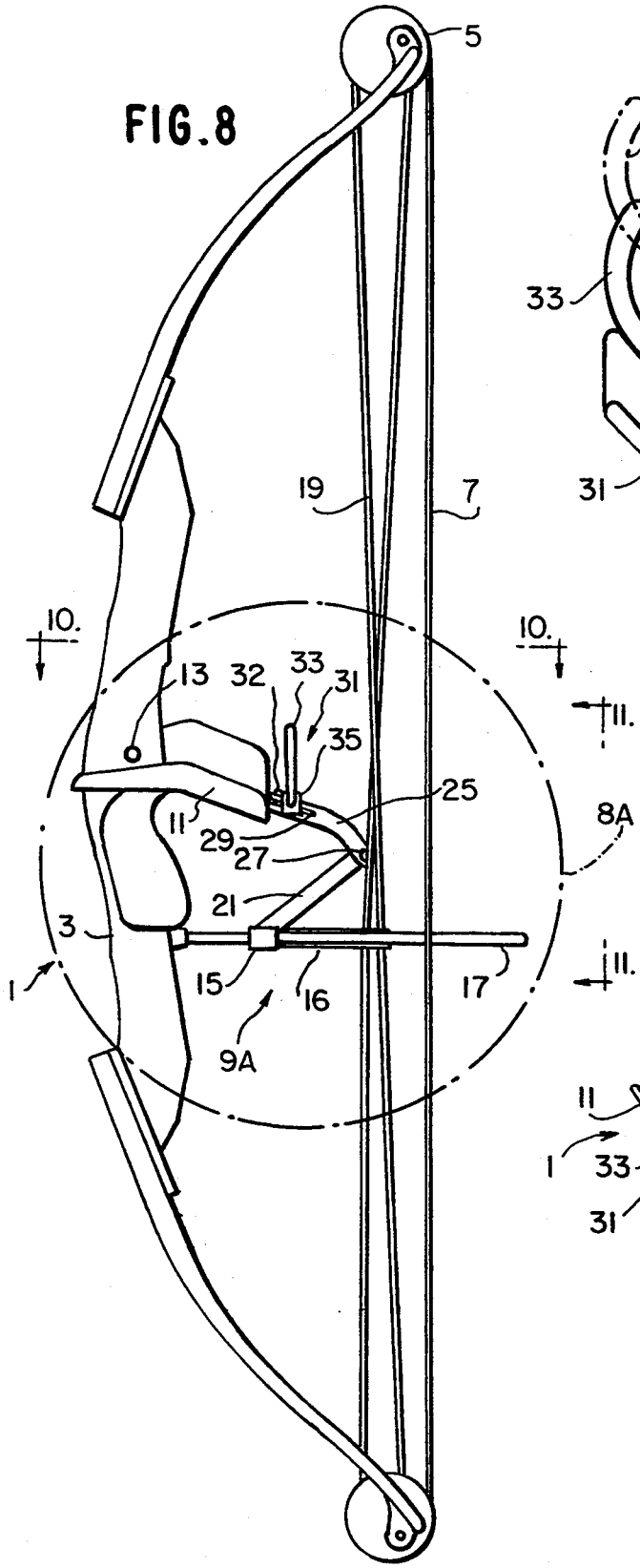
FIG. 8 is a diagrammatic view of a standard compound bow having a second embodiment of the arrow rest/overdraw assembly mounted thereto and being in a rest position.
Figure 8A:
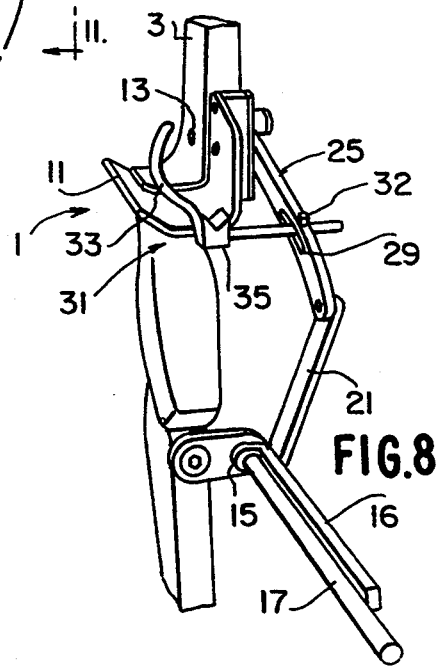
FIG. 8A is a detailed perspective view of the compound bow and arrow rest/overdraw assembly as shown in FIG. 8 in the rest position.

An alternate embodiment of the present invention is shown in FIGS. 8 and 8A. In this embodiment, the cable guard 17 is mounted on the lower section of the frame 3 of the compound bow 1. Thus, some components of the arrow rest/overdraw assembly 9A are mounted in an inverted manner with respect to corresponding components in arrow rest/overdraw assembly 9 (see, eg., FIG. 1). However, the operation of this embodiment is similar to that of the first embodiment as described below.

As in the first embodiment, the arrow rest/overdraw assembly 9A comprises a bracket 11 mounted to the frame 3 by a screw 13 or any suitable mounting device. The arrow rest/overdraw assembly further comprises a cable slide 15 slidably mounted to the cable guard 17 of the compound bow 1. In this second embodiment, extension piece 16 is integrally molded with the cable slide 15. The other end of extension piece 16 attaches to at least one of the tuning cables 19 of the bowstring 7 to mechanically couple cable slide 15 to the tuning cables 19. Extension piece 16 is needed to properly position actuator arm 21 and arrow rest/overdraw arm 25 with respect to the tuning cables 19 and to thereby properly position arrow rest/arrow guide assembly 31. Also, if necessary, such an extension piece can be used in the first embodiment.

The actuator arm 21 is pivotally mounted to the cable slide 15 by screw 23 (see FIG. 13) in an inverted manner with respect to the first embodiment. The other end of actuator arm 21 is pivotally mounted to the arrow rest-/overdraw arm 25 by screw 27.

The other end of arrow rest/overdraw arm 25 is pivotally mounted to the bracket and frame by screw 13 (see FIG. 13) in an inverted manner with respect to the first embodiment. As in the first embodiment, the arrow rest/overdraw arm 25 can be mounted to the bracket or frame by an independent screw.

As described in the first embodiment, the arrow rest-/overdraw arm 25 has a slot 29 with hole 34 disposed therein in which an arrow guide/arrow rest assembly 31 is slidably mounted and secured in place by screw 32. Arrow rest/arrow guide assembly 31 comprises an arrow guide 33 and arrow rest 35. Screw 32 can be adjusted to allow the arrow rest/arrow guide assembly 31 to move along within hole 34 to a desired position. As in the first embodiment, screw 32 can be, for example, a screw-type device which is tightened to position the arrow rest/arrow guide assembly 31 at a desired position and loosened to allow movement of the arrow rest/arrow guide assembly 31 within hole 34.

An adjustable height limit stop 37 comprises disc 41 which is mounted in an off-center fashion to the bracket 11 by screw 39 as in the first embodiment. Screw 39 can be unscrewed to allow the disc 41 to be moved in a desired position. When the arrow rest/overdraw arm 25 moves upward when the bowstring 7 is drawn back, as described hereunder, arrow rest/overdraw arm 25 abuts against disc 41 and thus, disc 41 prevents arrow rest/overdraw arm 25 from moving upward further. Hence, disc 41 can be rotated accordingly to allow more or less vertical movement of the arrow rest/overdraw arm 25.

Figure 9:
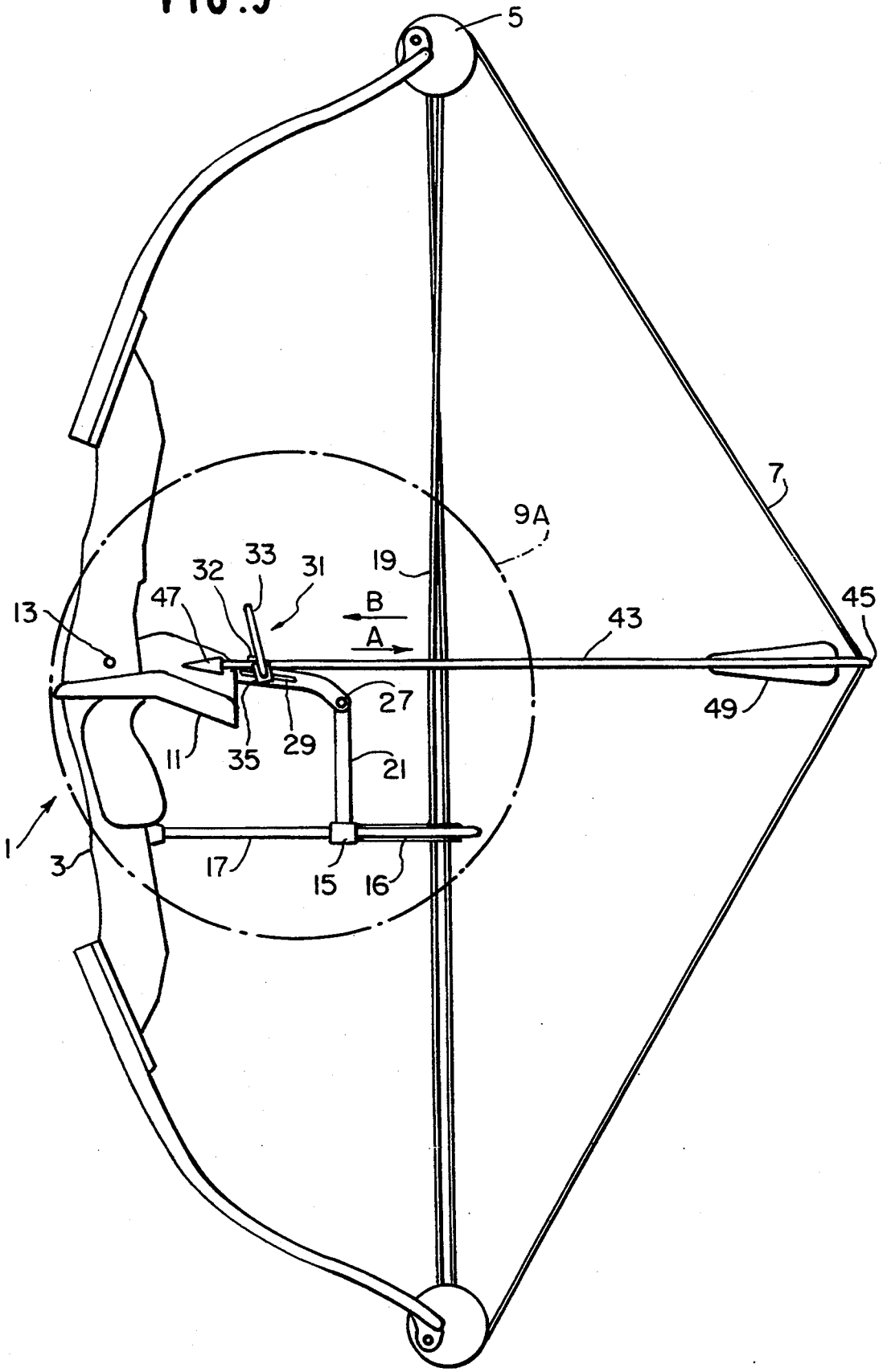
FIG. 9 is a diagrammatic view of the bow and arrow rest/overdraw assembly as shown in FIG. 8 in a drawn-back position.
Figure 9A:
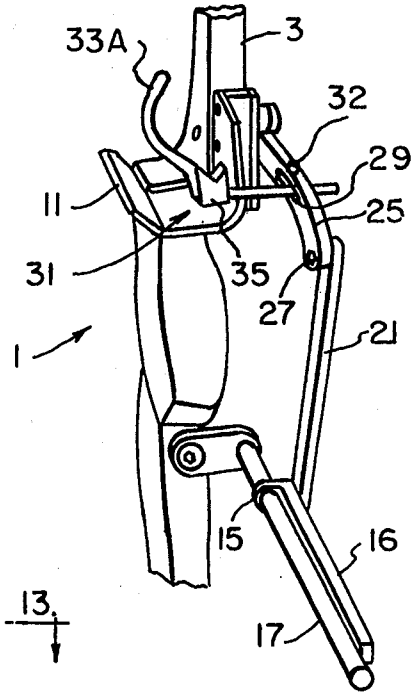
FIG. 9A is a detailed perspective view of the compound bow and arrow rest/overdraw assembly as shown in FIG. 9 in the drawn-back position.

As shown in FIG. 9, a short arrow 43 can be mounted in the compound bow 1 as in the first embodiment. As shown in FIGS. 8 and 8A, when the bowstring 7 is not drawn back, the arrow rest/overdraw arm 25 and actuator arm 27 are in a rest position. As the bowstring 7 is drawn back when the arrow 43 is loaded in the bow 1, the rearward lateral movement of the tuning cables 19 that occurs causes extension piece 16 and cable slide 15 to slide along the cable guard 17 in a direction toward the archer as shown by arrow A in FIG. 9. This movement causes the actuator arm 21 to pivot relative to the arrow rest/overdraw arm 25. As shown in FIGS. 9 and 9A, this pivoting action lifts the arrow rest/overdraw arm 25 and thus lifts the arrow guide/arrow rest assembly 31 to lift the arrow 43 in a firing position. This movement is further illustrated in FIGS. 10–13.

Figure 11:
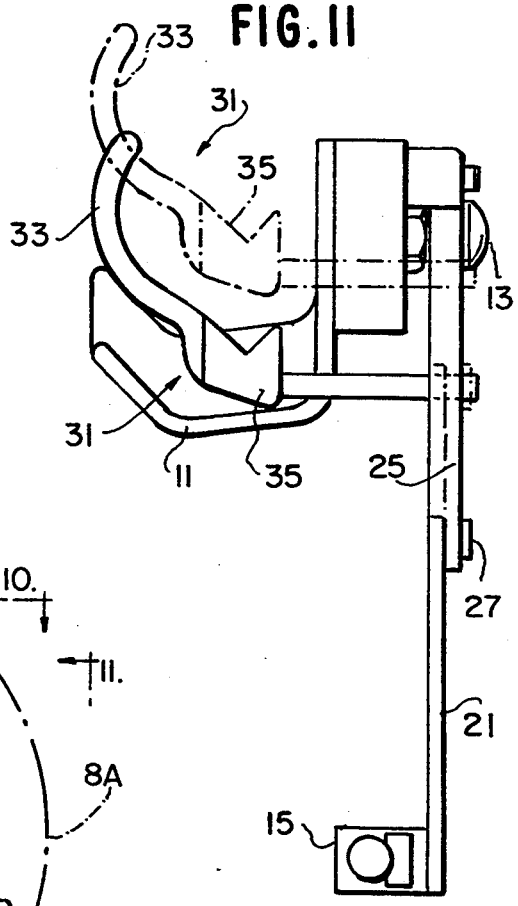
FIG. 11 is a diagrammatic view of the arrow rest/overdraw assembly of FIG. 8, less the compound bow, taken along lines 11—11 in FIG. 8.
Figure 10:
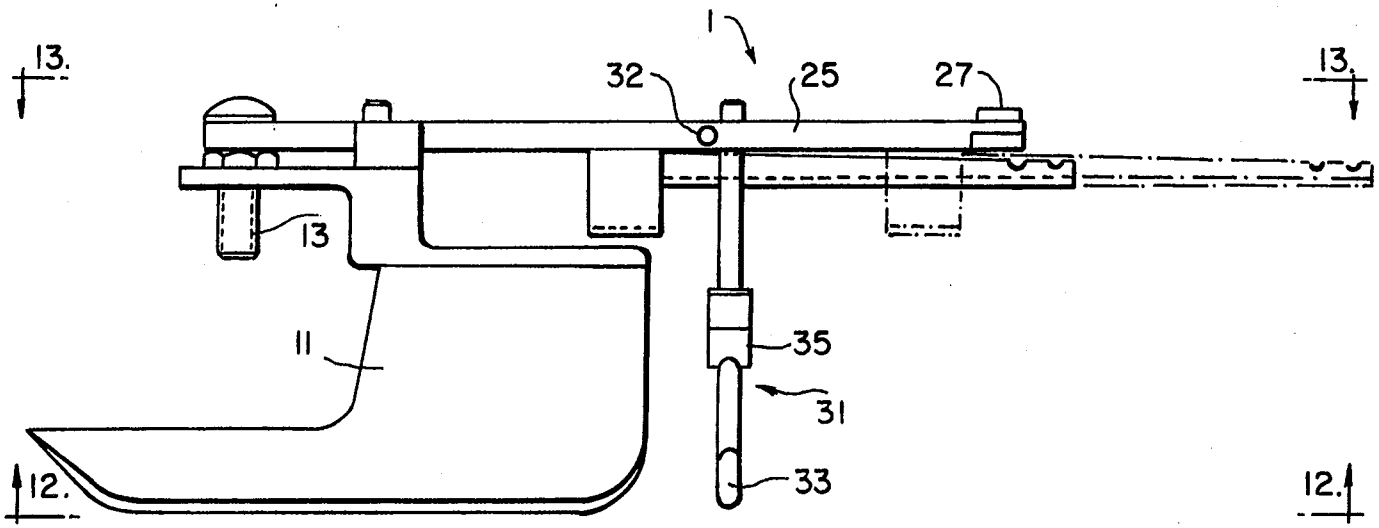
FIG. 10 is a diagrammatic view of the arrow rest/overdraw assembly of FIG. 8, less the compound bow, taken along lines 10—10 in FIG. 8.

For example, as shown in FIG. 10, the arrow rest-/overdraw assembly 9 is in the rest position, and moves into the loaded position as cable slide 15 and extension piece 16, which is preferably integral with cable slide 15, move backward. As shown in FIG. 11, the arrow rest/arrow guide assembly 31 moves in an upward position to lift the arrow in a loaded position ready for release.

Figure 12:
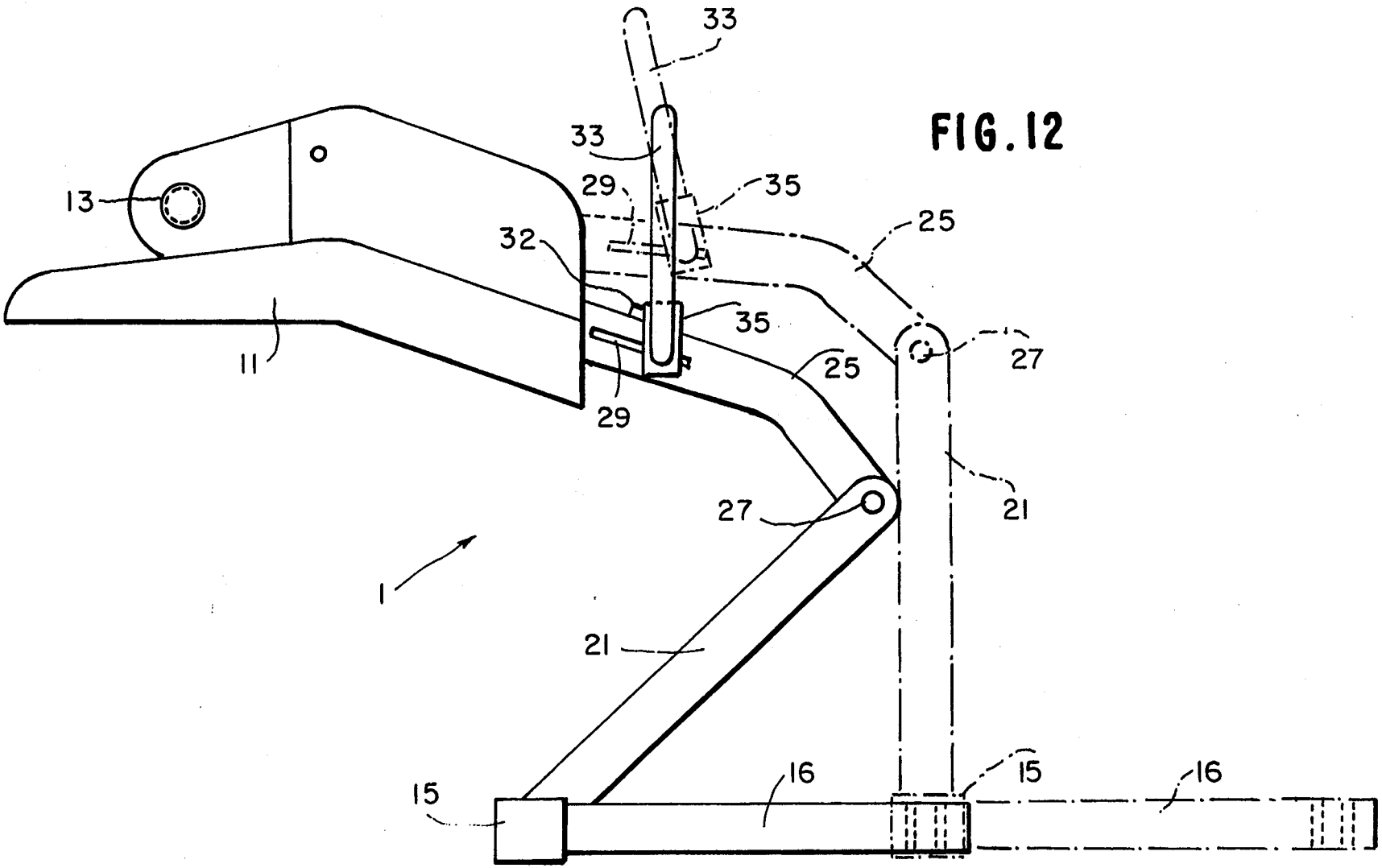
FIG. 12 is a diagrammatic view of the arrow rest/overdraw assembly, less the compound bow, taken along lines 12—12 in FIG. 10.
Figure 13:
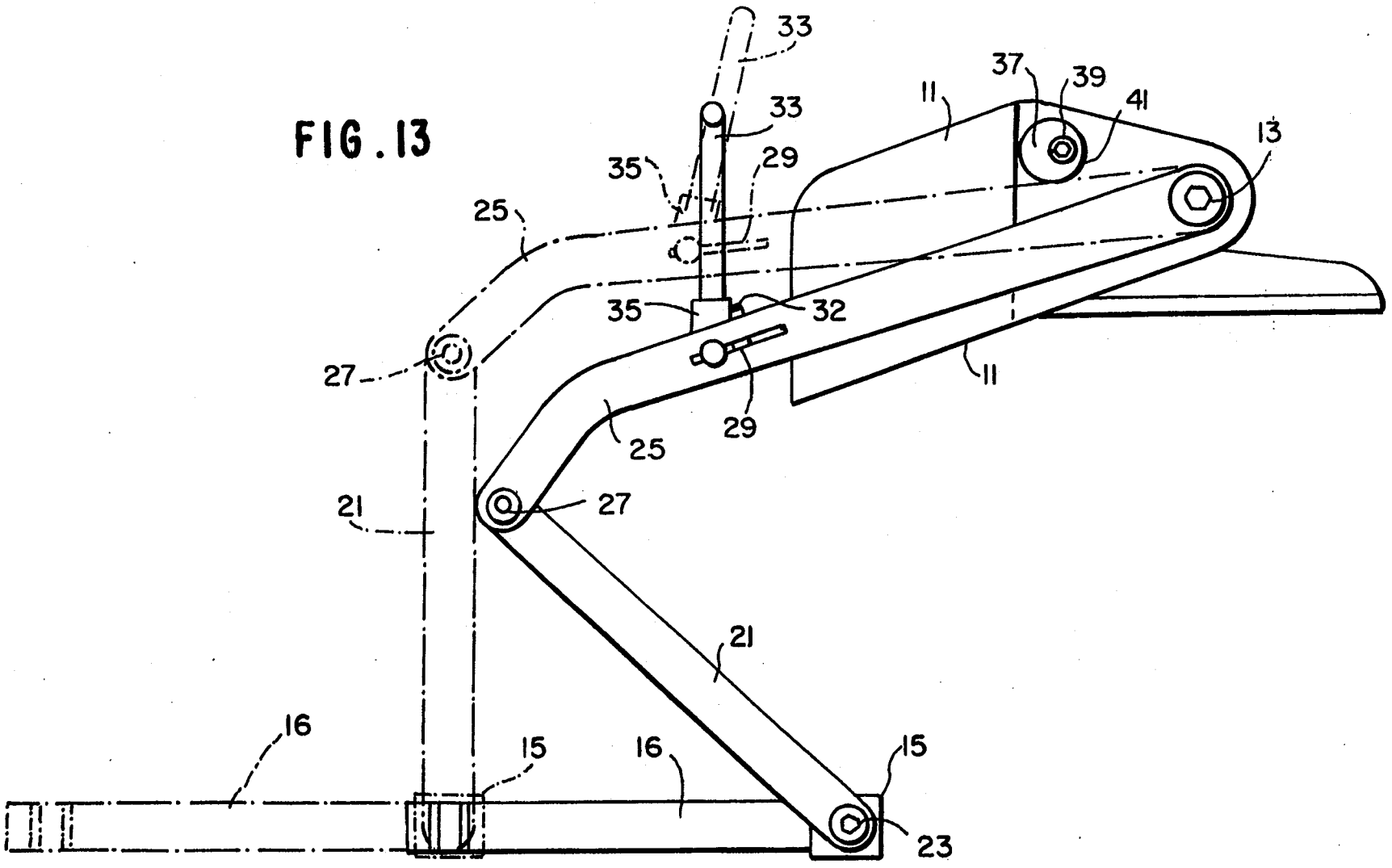
FIG. 13 is a diagrammatic view of the arrow rest/overdraw assembly, less the compound bow, taken along lines 13—13 in FIG. 10.

FIGS. 12 and 13 illustrate how the actuator arm 21 pivots relative to the arrow rest/overdraw arm 25 at screw 27 to move the arrow rest/arrow guide assembly 31 in an upward direction. Also, as shown in FIG. 13, in a manner similar to that of the first embodiment, the arrow rest/overdraw arm 25 abuts against the disc 41 which prevents further vertical movement.

When the bowstring 7 is released, the bow 1 returns to its rest state and thus the bowstring 7 pushes the arrow 43 forward in a direction of flight. When this occurs, the forward movement of the tuning cables 19 move the extension piece 16 and cable slide 15 in a direction shown by arrow B in FIG. 9.

This movement is in reverse to the movement caused by drawing the bowstring 7 back and thus, the actuator arm 21 pivots relative to arrow rest/overdraw arm 25 about pivot screw 27. This movement causes the arrow rest/overdraw arm 25 to move out of the path of the arrow 43 and thus moves the arrow guide/arrow rest assembly 31 out of the path of the arrow 43 before the fletching 49 of the arrow 43 reaches the arrow rest/arrow guide assembly 31. Hence, as in the first embodiment, no interference between the fletching and the arrow rest 35 or arrow guide 31 occurs and an accurate flight of the arrow 43 is achieved.

Although only a few exemplary embodiments of this invention have been described in detail above, those skilled in the art will readily appreciate that many modifications are possible in the exemplary embodiments without materially departing from the novel teachings and advantages of this invention. Accordingly, all such modifications are intended to be included within the scope of this invention as defined in the following claims.

What is claimed is:

1. An arrow rest and overdraw apparatus for use with a compound bow, said compound bow comprising a frame having a cable guard extending therefrom, and a bowstring having a tuning cable, said apparatus comprising:

a first arm, adapted to pivotally couple to said frame and having an arrow rest assembly coupled thereto;

a second arm pivotally coupled to said first arm; and a cable slide, pivotally coupled to said second arm, and adapted to slidably mount to said cable guard and couple to said tuning cable to cause said second arm to pivot said first arm when said bowstring is pulled in a direction away from said frame to cause said first arm to move said arrow rest assembly in a first substantially vertical direction, and to cause said second arm to pivot said first arm when said bowstring is released to cause said first arm to move said arrow rest assembly in a second substantially vertical direction substantially opposite to said first substantially vertical direction.

2. An apparatus as claimed in claim 1, wherein said arrow rest assembly comprises an arrow rest for positioning an arrow loaded in said bow, and an arrow guide for guiding said arrow to said arrow rest when said arrow is loaded in said bow.

3. An apparatus as claimed in claim 1, wherein said cable guard causes said second arm to pivot substantially parallelly to said first arm when said cable guard is coupled to said tuning cable and said bowstring is pulled in said direction and released.

4. An apparatus as claimed in claim 1, further comprising means for stopping said first arm from moving said arrow rest assembly in said substantially vertical direction.

5. An apparatus as claimed in claim 1, wherein said first and second arms each comprise first and second ends, said first end of said first arm is adapted to pivotally couple to said frame, said first end of said second arm is adapted to pivotally couple to said cable guard, and said second ends of said first and second arms are pivotally coupled to each other.

6. An apparatus as claimed in claim 1, wherein when said first arm is coupled to said frame, said first arm positions said arrow rest assembly at a predetermined distance away from said frame in a direction of said bowstring.

7. An apparatus as claimed in claim 1, wherein said first arm has an opening therein, and said arrow rest assembly is slidable in said opening.

8. An apparatus as claimed in claim 7, further comprising means for securing said arrow rest assembly at a position in said opening.

9. A springless arrow rest and overdraw apparatus for use with a compound bow, said compound bow comprising a frame having a cable guard extending therefrom, and a bowstring having a tuning cable, said apparatus comprising:

means, adapted to couple to said frame and having an arrow rest assembly coupled thereto, for moving said arrow rest assembly in a substantially vertical direction between a first position and a second position; and means, adapted to slidably mount to said cable guard and couple to said tuning cable, for causing, without the aid of a spring internal to said arrow rest and overdraw apparatus, said moving means to move said arrow rest assembly to said second position when said bowstring is pulled in a direction away from said frame and said moving means to return said arrow rest assembly to said first position when said bowstring is released.

10. An apparatus as claimed in claim 9, wherein said moving means is adapted to pivotally couple to said frame, and when said moving means is coupled to said frame, said causing means causes said moving means to pivot with respect to said frame to move said arrow rest assembly between said first and second positions.

11. An apparatus as claimed in claim 9, wherein said arrow rest assembly comprises an arrow rest for positioning an arrow loaded in said bow, and an arrow guide for guiding said arrow to said arrow rest when said arrow is loaded in said bow.

12. An apparatus as claimed in claim 9, wherein said moving means has an opening therein, and said arrow rest assembly is slidable in said opening.

13. An apparatus as claimed in claim 12, further comprising means for securing said arrow rest assembly at a position in said opening.

14. An apparatus as claimed in claim 9, wherein when said moving means is coupled to said frame, said moving means positions said arrow rest assembly at a predetermined distance from said frame in a direction of said bowstring.

15. A springless arrow rest and overdraw apparatus for use with a compound bow, said compound bow comprising a frame having a cable guard extending therefrom, and a bowstring having a tuning cable, said apparatus comprising:

means, adapted to couple to said frame, for moving an arrow rest assembly in a substantially vertical direction between a first position and a second position, said moving means comprising:

a first arm, adapted to pivotally couple to said frame and having said arrow rest assembly coupled thereto; and a second arm pivotally coupled to said first arm; and means, adapted to slidably mount to said cable guard and couple to said tuning cable, for causing said moving means to move said arrow rest assembly to said second position when said bowstring is pulled in a direction away from said frame and said moving means to return said arrow rest assembly to said first position when said bowstring is released.

16. An apparatus as claimed in claim 15, wherein said causing means is pivotally coupled to said second arm and, when said first arm is coupled to said frame, causes said second arm to pivot said first arm with respect to said frame when said bowstring is pulled in said direction and released.

17. An apparatus as claimed in claim 15, further comprising means for stopping said first arm from moving said arrow rest assembly toward said second position.

18. An apparatus as claimed in claim 15, wherein said arrow rest assembly comprises an arrow rest for positioning an arrow loaded in said bow, and an arrow guide for guiding said arrow to said arrow rest when said arrow is loaded in said bow.

19. An apparatus as claimed in claim 15, wherein said moving means has an opening therein, and said arrow rest assembly is slidable in said opening.

20. An apparatus as claimed in claim 19, further comprising means for securing said arrow rest assembly at a position in said opening.

* * * * *